US006142087A

United States Patent [19]

Pofalla et al.

[11] Patent Number: 6,142,087

[45] Date of Patent: Nov. 7, 2000

[54] CUTTING DEVICE FOR CREATING A SLIT OPENING FOR A BUTTONHOLE

[75] Inventors: Bernd Pofalla, Bielefeld; Christian Möllenkamp, Offenbach, both of Germany

[73] Assignee: Dürkopp Adler AG, Germany

[21] Appl. No.: 09/362,525

[22] Filed: Jul. 28, 1999

[30] Foreign Application Priority Data

Aug. 6, 1998 [DE] Germany ..... 198 35 500

[51] Int. Cl.[7] ..... D05B 37/02

[52] U.S. Cl. ..... 112/68

[58] Field of Search ..... 112/66, 68, 70, 112/76, 122, 129; 83/905, 910, 936, 954

[56] References Cited

U.S. PATENT DOCUMENTS

| | | | |
|---|---|---|---|
| 3,847,097 | 11/1974 | Dusch et al. | 112/68 |
| 5,085,158 | 2/1992 | Goldbeck et al. | 112/68 |
| 5,974,990 | 11/1999 | Goldbeck et al. | 112/68 |

FOREIGN PATENT DOCUMENTS 7634151 4/1977 Germany .

OTHER PUBLICATIONS

Dürkopp Adler AG, 576, imprint 0002 009122 2470 D/GB, Dec. 1997.

*Primary Examiner*—Ismael Izaguirre

*Attorney, Agent, or Firm*—Ostrolenk, Faber, Gerb & Soffen, LLP

[57] ABSTRACT

A cutting device in a sewing machine for creating a slit opening for a buttonhole in a workpiece. First and second tool parts are spaced apart from each other in an open position and can be brought together in a closed position. One tool part has a block and the other tool part has a cutting edge. The block is formed in the shape of a strip, is accepted into a slit located on the sewing machine and is attached there with a clamping device. A slit opening can be created in a workpiece in a block-cutting mode by the cutting edge and the block. The cutting device can also be used for making a slit opening in a workpiece in a slit-cutting mode by removing the block and providing a different cutting edge, which can be performed in a simple manner.

9 Claims, 2 Drawing Sheets

Fig. 3
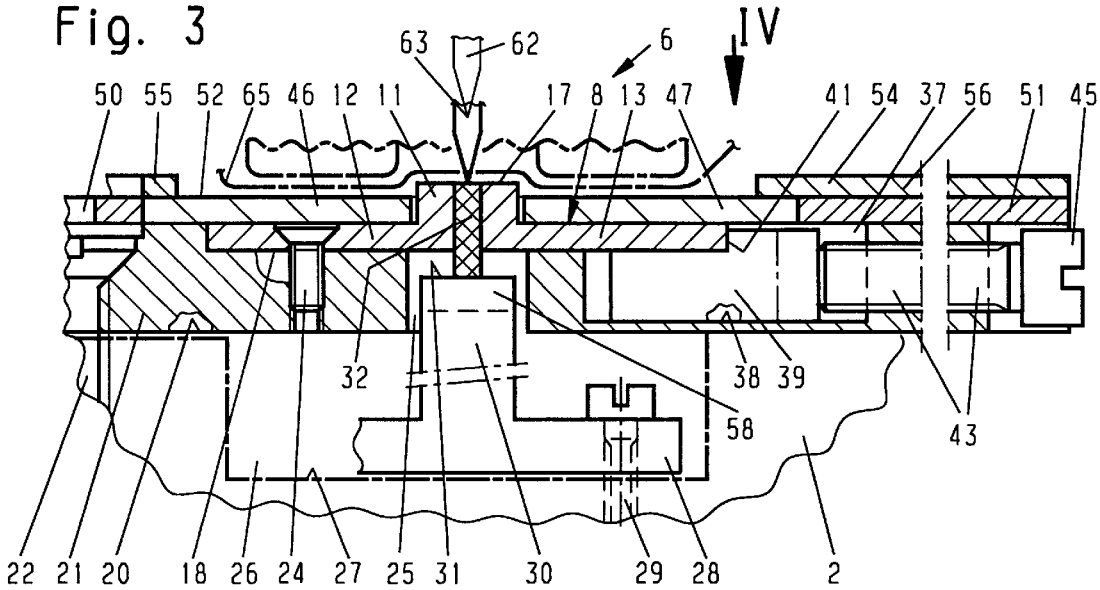
Fig. 4
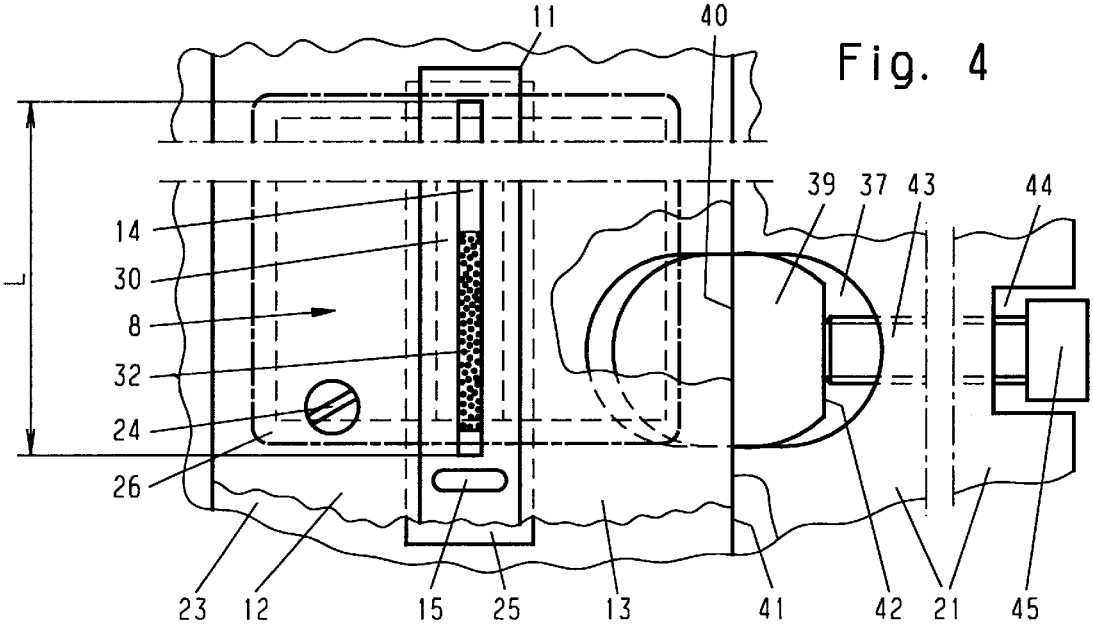
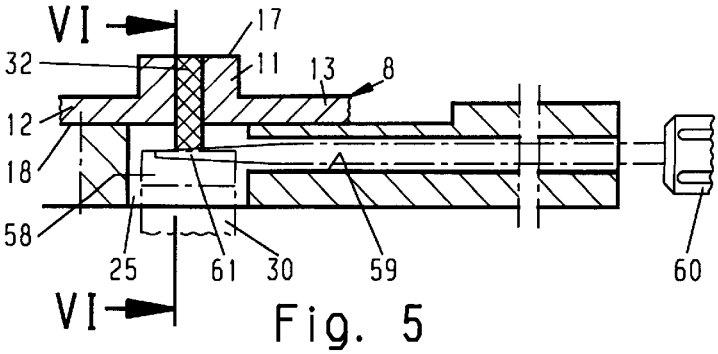
Fig. 5
Fig. 9
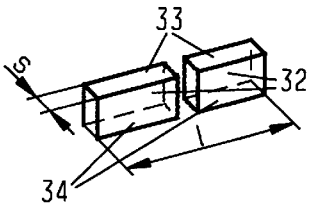

CUTTING DEVICE FOR CREATING A SLIT OPENING FOR A BUTTONHOLE

BACKGROUND OF THE INVENTION

The present invention relates to a cutting device for creating a slit opening for a buttonhole.

A cutting device of this kind in a buttonhole sewing machine is known from a brochure entitled DÜRKOPP ADLER AG, 576, imprint 0002 009122 2470 D/GB 12/97. With it, a slit opening for a buttonhole can be created in two ways, in a slit-cutting mode or in a block-cutting mode. Two tool parts are used for this process.

In the slit-cutting mode, the slit opening is created by a knife that enters into a slit in a supporting plate on which lies the workpiece. In the block-cutting mode, in contrast, the slit opening is created by placing a knife on a flat working surface of a so-called cutting block, whereby the knife penetrates the workpiece placed on the working surface and thereby creates the slit opening. One cutting mode or the other is used according to the material properties of each workpiece to be cut.

In the known cutting device, conversion of the working mode from one cutting mode to the other is carried out by exchanging the tool parts, that is, by using associated tool parts for each mode. While the moving tool parts can be exchanged without problems, changing the cutting or supporting surfaces involves a significant expenditure in cost and time. This is because of the fact that a bearing plate consisting of a large number of parts, including a thread-cutting device, must be exchanged. Accordingly, in order to implement one cutting mode or the other, it is necessary to store the tool parts required for both modes. If, on the other hand, a customer's buttonhole sewing machine equipped for one cutting mode or the other is to be converted, conversion is possible only if the corresponding tool parts are present or purchased, which involves a certain delivery time and cost for the tool parts.

Another disadvantage of the known cutting device is the difficulty of securing and removing the cutting block to and from the slit in the bearing plate. The slit and the cutting block are dimensioned in such a way that the cutting block must be pressed manually into the slit with great force and also must be pressed out manually with great force. For this, the cutting block is constructed with chamfers, by means of which intermediate spaces are formed at the sides of the cutting block. For this reason, only one good clamping position of the workpiece is possible, which affects the precision of the placement of the cut between the stitch rows.

With this type of attachment, i.e., with the chamfers provided on the cutting block, it is not possible to hold the cutting block on its sides. This presents an especially critical problem when the cutting block—as is the case in the known cutting device—is made of plastic and the danger exists of premature splitting because of the penetrating knife.

The plastic block accepted by the bearing plate is constructed with a free cut at each of its ends, so that reuse of a cutting block that has been split on one side is limited to using one other position, i.e. there are only two usable positions. Accordingly, it is necessary to provide sufficient spare cutting blocks.

SUMMARY OF THE INVENTION

A central feature of the invention is a cutting device wherein the procedure for carrying out either the slit-cutting mode or the block-cutting mode can be achieved while avoiding cost-intensive components, with a simultaneous increase in the useful life of the components, and with increased quality of the slit opening.

These features may be obtained by a cutting device for creating a slit opening for a buttonhole in a workpiece, having the following characteristics:

- first and second tool parts, which are spaced apart in an open position and can be brought together and positioned near each other in a working position,
- the second tool part has a long slit and the first tool part has a knife that can be inserted into the slit to create the slit opening in a slit-cutting mode, or
- the second tool part has a block with a working surface and the first tool part has a cutting edge that is disposed parallel to the working surface in the working position to create the slit opening in a block-cutting mode,
- the block is constructed in the form of a strip that has a thickness corresponding to the width of the slit and a length that corresponds at most to the lengthwise extension of the slit,
- one surface of the block forms the working surface,
- the block can be received by the slit, with the working surface in alignment with the upper edge of the second tool part, and
- a surface of the block opposite to the working surface is supported on a support surface.

With the invention, a cutting device is provided that makes it possible to use the tool parts in the slit-cutting mode or the block-cutting mode in a simple way, using one single bearing plate, that is, a bearing plate that can be used in both modes. Especially advantageous is the double use of the slit, which in the slit-cutting mode can be used as an abutment for the workpiece and in the block-cutting mode can accept the cutting block. The cutting block can be produced simply and at low cost, and is held closely, laterally to the place where the force is applied, thus optimally resisting slitting by the penetrating counter-tool. Moreover, the cutting block received in the slit leads to a construction with continuous support for the workpiece. Thus, an optimal clamping of the workpiece is possible, whereby precisely placed slit openings can be produced.

The block may have a second working surface on the side opposite to the first working surface, which permits further use of the cutting block in a second position.

The slit and the block may be constructed in such way that the block can be accepted into the slit in four positions, i.e., its upper and lower surfaces can be reversed and it can also be rotated in a horizontal plane. With this implementation of the slit and the block, dependency on spare cutting-block parts is reduced and costs for such spare parts are saved.

If the second tool part which has the slit is constructed with a clamping device to seat the block in the slit, the useful life of the cutting block is increased. If the clamping device is constructed with at least one screw to seat the block by narrowing the slit, a side tension and thereby the best possible support for the cutting block in the slit are achieved, so that the cutting device works very effectively and precisely. In addition, the securing of the cutting block by clamping has the advantage that removing or inserting a cutting block is made easier.

If the block is made of plastic (POM), the useful life of the knife is increased. By configuring the second tool part so that an ejector (such as a screwdriver) can move the block out of the slit, it is easier to remove the cutting block from the slit. The use of a commercially available screwdriver as the ejector leads to a cost-favorable form of construction using a tool that is otherwise available on the machine.

Reference will also be made to German Utility Model DE 76 34 151, in which a cutting device is described that is equipped with tool parts to create a slit opening in the slit-cutting mode or in the block-cutting mode. No indications can be found in this publication that would lead to the features and advantages of the invention disclosed herein.

Other features and advantages of the present invention will become apparent from the following description of the invention which refers to the accompanying drawings.

BRIEF DESCRIPTION OF THE DRAWINGS

FIG. 3 shows a section corresponding to section line III—III in FIG. 2 on a larger scale, wherein the view has been rotated counter-clockwise by 90 degrees, FIG. 4 shows a view of the region represented in FIG. 3, corresponding to arrow IV in FIG. 3, FIG. 5 shows a section view corresponding to section line V—V in FIG. 2 on a larger scale, whereby the view has been rotated counter-clockwise by 90 degrees, FIG. 9 shows a perspective view of a detail of the cutting device.

DETAILED DESCRIPTION OF AN EMBODIMENT OF THE INVENTION

Structure of the Cutting Device

Figure 1:
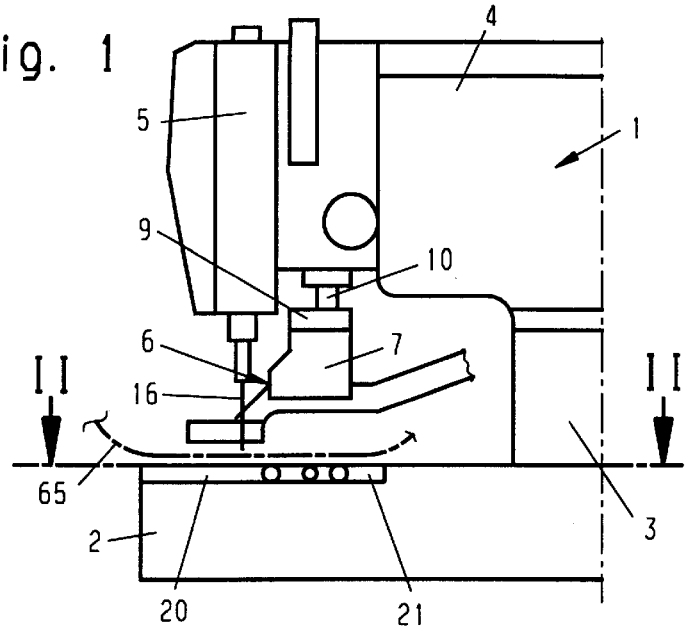
FIG. 1 shows a front view of a buttonhole sewing machine with the cutting device.
Figure 8:
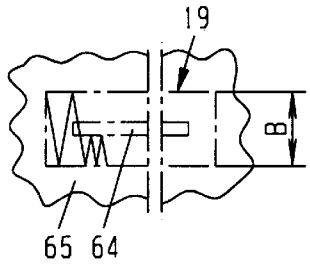
FIG. 8 shows a workpiece with a buttonhole.

A buttonhole sewing machine 1 is constructed with a base plate 2, a stand 3 and an arm 4 connected to it. The free end of the arm 4 ends in a head 5. The buttonhole sewing machine 1 is constructed with a cutting device 6, which has a first tool part 7 and a second tool part 8. The first tool part 7 is firmly attached to a tool holder 9 by a screw connection (not shown). The tool holder 9 is constructed so that it is firmly attached to the lower end of a rod 10, which can be moved axially, but is attached with a bearing so that it cannot turn in the head 5 of the buttonhole sewing machine 1. Inside the head 5, there is a shifting drive (not shown) that is operatively connected to the rod 10 and is a component of the cutting device 6.

The second tool part 8 is constructed with a protruding bridge 11 and adjacent flanges 12, 13 at its sides. In the middle of the bridge 11, an elongated slit 14 is constructed, which has for example a width b of about one millimeter and a length L of about fifty millimeters.

In addition, there is an elongated stitch hole 15 in the bridge 11 for unhindered penetration of a needle 16, which moves up and down. Finally, the second tool part 8 is constructed with an upper side 17, adjacent to the bridge 11, and a lower side 18. The bridge 11 is dimensioned with a width that varies depending on the width B of a buttonhole 19.

The base plate 2 has a screw surface 20 onto which a bearing plate 21 is attached for example with flat-head screws 22. The bearing plate 21 is constructed with a recess 23 in which the above-mentioned second tool part 8 is received and the flanges 12, 13 are attached with flat-head screws 24. The arrangement described is such that the bridge 11 and the slit 14 run parallel to the lengthwise direction of the arm 4.

In the region below the slit 14 and in the middle thereof (FIGS. 3 and 4), the bearing plate 21 is constructed with a rectangular cutout 25.

The base plate 2 is constructed at the screw surface 20 with a U-shaped indentation 26, on the bottom surface 27 of which a support bearing 28 is attached with screws, only one screw 29 of which is shown as an example. The support bearing 28 is constructed with an upside-down T-shaped cross-section (FIG. 3), the bridge 30 of which has a supporting surface 31. The bridge 30 extends upwards into the cutout 25 of the bearing plate 21. The construction is such that the support surface 31 is at a distance of about two millimeters below the lower side 18 of the second tool part 8.

In the slit 14, a block 32 in the form of a strip is accepted, which has a thickness s and a length 1. The thickness s corresponds approximately to the width b of the slit 14. The length 1 of the block 32 corresponds at most to the long dimension L of the slit 14. The surfaces formed with thickness s and length 1 form a first working surface 33 and a second working surface 34 (FIG. 9). Also, the block 32 is dimensioned in its height so that the second working surface 34 lies on the supporting surface 31 and the first working surface 33 is in alignment with the upper side 17 of the second tool part 8. The strip-shaped block 32 is made of plastic, for example polyoxymethylene (POM).

Figure 2:
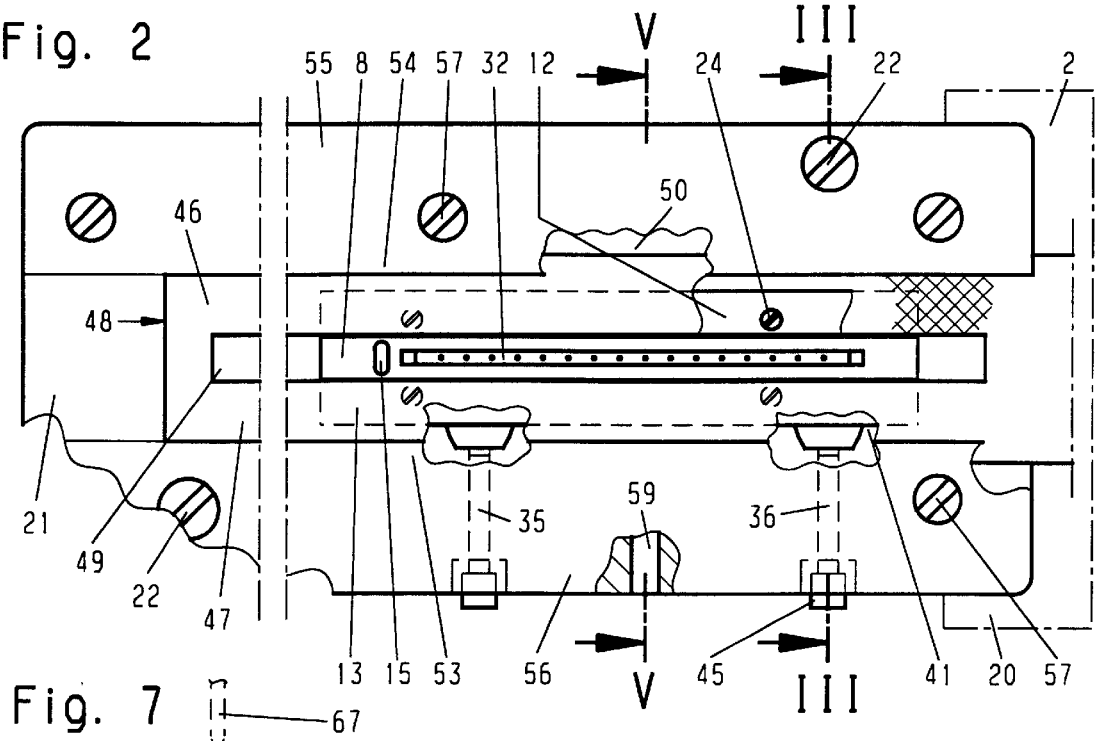
FIG. 2 shows a view of a lower part of the cutting device, corresponding to viewing line II—II in FIG. 1 on a larger scale.

The bearing plate 21 is constructed according to FIG. 2 with two clamping devices 35, 36 (FIG. 2) which are identical in their construction. In the following, clamping device 36 is described by way of example, by means of FIGS. 3 and 4. The bearing plate 21 is constructed with an oval-shaped recess 37, which is limited from below by a floor 38. In the recess 37, a clamping piece 39 is accepted, which is likewise oval-shaped, but constructed shorter in length than the recess 37.

The clamping piece 39 is also constructed with an edge 40 that lies on one side edge 41 of the flange 13. In addition, the clamping piece 39 is constructed with a flat portion 42, against which lies the front end of a set screw 43. The set screw 43 can be adjusted with great force in a threaded hole (not shown) in the bearing plate 21. In addition, the bearing plate 21 is constructed with a free cut 44 for the head 45 of the set screw 43.

According to FIG. 3, parts 46, 47 of a slider 48 are arranged on the flanges 12, 13, whereby the parts 46, 47 define a rectangular cutout 49 between themselves. The cutout 49 is longer than the bridge 11 of the second tool part 8 which is inserted into the cutout 49, so that the slider 48 can move back and forth in the direction of its lengthwise extension with respect to the fixed bridge 11. The slider 48 is guided laterally by spacers 50, 51, which are dimensioned to be somewhat thicker than the slider 48 itself. With the flange 13 and the spacer 51, the oval-shaped recess 37 with the clamping piece 39 accepted into it are both covered at the same time. In this embodiment, the clamping piece 39 can be moved easily in the oval-shaped recess 37.

Also, the slider 48 is guided on its upper side 52 by the borders 53, 54 of the cover plates 55, 56. These plates are attached to the bearing plate 21 with screws 57 and permit unhindered motion of the slider 48 with respect to the bearing plate 21.

Figure 6:
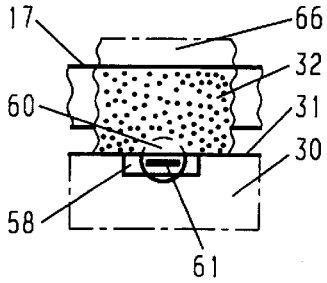
FIG. 6 shows a section view corresponding to section line VI—VI in FIG. 5.

The bridge 30 is constructed on its support surface 31 with a groove 58 that may be about five millimeters wide and two millimeters deep, which runs perpendicular to the lengthwise direction of the bridge 30 and is approximately symmetrical with respect to section line V—V (FIGS. 2, 5, and 6). Approximately in the middle of the groove 58, the bearing plate 21 is constructed with a hole 59. As shown in FIGS. 5 and 6, the hole 59 is dimensioned in such a way that a small screwdriver 60 with a blade 61 about 4 millimeters wide, for example, can be inserted into it with play. In this way, the blade 61 protrudes into the region of the groove 58, and thereby under the second working surface 34 of block 32.

Operation of the Cutting Device in the Block-cutting Mode

According to the above description, the strip-shaped block 32 is located in the slit 14. Here, block 32 is firmly attached by means of the clamping devices 35 and 36. This occurs in each case by means of the set screw 43 that moves the clamping piece 39 forward (to the left, according to FIGS. 3 and 4). In this way, the clamping piece 39 with edge 40 lies at the side edge 41 of flange 13. Due to elastic deformation, the slit 14 is narrowed and thereby block 32 is firmly fixed, and lies with its inactive, second working surface 34 on the supporting surface 31 of the bridge 30.

For the cutting process, the first tool part 7, which is a knife 62 with a cutting edge 63 constructed parallel to the working surface 33 (FIG. 3), is lowered vertically from an open position above the block 32 (shown with a dotted line) to a lowered working position (shown with a solid line). In this lowering movement, the knife 62 with its cutting edge 63 runs parallel to the working surface 33, with its full width, creating a slit opening 64 in a workpiece 65, whereby the cutting edge 63 finally enters the block 32 for a small residual path which may be up to about 0.8 millimeters. In the working position, the tool parts 7, 8, and thus the knife 62 and block 32 arrive at a position near each other.

If the working surface 33 splits, the block 32 can be raised and removed manually, by loosening the clamping devices 35, 36, and using the screwdriver 60 as an ejector to push up the block 32 into the position 66 shown in dotted lines in FIG. 6.

Block 32 can be placed in the slit 14 in up to four positions. It an be rotated in a horizontal plane, and can also be inverted so as to reverse the upper surface 33 and the lower surface 34. This is useful when the block is not split at the working surfaces over its entire length. In case of a complete split of both working surfaces 33, 34, block 32 must be replaced by a new one. Turning or replacing block 32 is simple and can be performed without a great expenditure of time by the person operating the machine.

For the quality of the slit opening 64, it is of great importance that the workpiece 65 be clamped on the second tool part 8, without any intermediate space. This requirement is met by the smallest possible construction space for placing block 32.

Operation of the Cutting Device in the Slit-cutting Mode

The procedure in this mode is made possible by a simple conversion of the cutting device 6 described above, which can be performed simply and in a short time. For this, the clamping devices 35, 36 are removed by loosening the two screws corresponding to the set screw 45. Now it is possible to remove the block 32 located in the slit 14 with the aid of the screwdriver 60, which functions as an ejector, so that block 32 assumes the forward position 66 shown dotted in FIG. 6 and it can then be removed manually.

Figure 7:
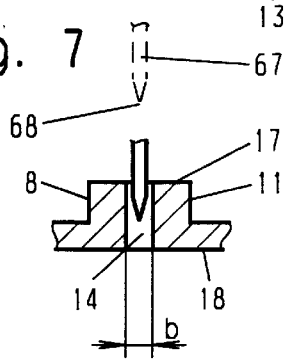
FIG. 7 shows a front view of the first and second cutting tool parts in an open position and in a working position.

After the exchange of the movable tool parts 7, that is, inserting a knife 67 with a blade 68, the conversion is complete. The knife 67 is constructed in such a way that the blade 68, as it moves from the open position (shown with dotted lines) to the working position (shown with solid lines) goes completely into the slit 14 (FIG. 7). In this case the upper side 17 serves as a support for the workpiece 65 placed upon it.

Since the slit opening 64 is formed according to the slit-cutting mode with the same second tool part 8, the above-mentioned advantages of precise placement of the slit opening 64 and the clamping of the workpiece 65 apply here as well.

Although the present invention has been described in relation to a particular embodiment thereof, many other variations and modifications and other uses will become apparent to those skilled in the art. Therefore, the present invention is not limited by the specific disclosure herein.

What is claimed is:

1. A cutting device for creating a slit opening for a buttonhole in a workpiece, comprising:

first and second tool parts, which are movable apart from each other in an open position and adjacent to each other in a working position, the cutting device being operable alternatively in either a slit-cutting mode or a block-cutting mode, wherein:

the second tool part has an elongated slit and the first tool part has a knife that, in the slit-cutting mode, is movable into the slit to create the slit opening, and in the block-cutting mode, a block is received in said elongated slit in said second tool part, the block having a working surface and the first tool part having a cutting edge that is movable to the working surface to create the slit opening, the block having the form of a strip and having a thickness corresponding to the width of said elongated slit and a length that corresponds at most to a lengthwise extension of the slit, an upper surface of the block having said thickness and said length, forms the working surface, the block is receivable in the slit with the working surface in alignment with an upper edge of the second tool part, and the block has a support surface on a lower side thereof opposite to the working surface.

2. A cutting device according to claim 1, wherein said support surface of the block is usable as a second working surface.

3. A cutting device according to claim 2, wherein the slit and the block are constructed in such way that the block can be accepted into the slit in four positions.

4. A cutting device according to claim 1, wherein the second tool part has a clamping device which secures the block in the slit.

5. A cutting device according to claim 4, wherein the clamping device has at least one screw which secures the block by narrowing the slit.

6. A cutting device according to claim 1, wherein the block is made of a plastic.

7. A cutting device according to claim 6, wherein the second tool part is configured for receiving an ejector for moving the block out of the slit.

8. A cutting device according to claim 7, wherein said ejector comprises a screwdriver.

9. A cutting device according to claim 6, wherein said plastic is POM.

* * * * *